US011454066B1

(12) United States Patent
Herrick

(10) Patent No.: US 11,454,066 B1
(45) Date of Patent: Sep. 27, 2022

(54) OPEN PATH HORIZONTAL PIPE RAMMER FOR VARIABLE PIPE DIAMETER

(71) Applicant: RODDIE, INC., Columbia Falls, MT (US)

(72) Inventor: Rod Herrick, Whitefish, MT (US)

(73) Assignee: RODDIE, Inc., Columbia Falls, MT (US)

( * ) Notice: Subject to any disclaimer, the term of this patent is extended or adjusted under 35 U.S.C. 154(b) by 0 days.

(21) Appl. No.: 17/196,699

(22) Filed: Mar. 9, 2021

Related U.S. Application Data

(60) Provisional application No. 62/987,222, filed on Mar. 9, 2020.

(51) Int. Cl.
*E21B 11/02* (2006.01)
*E21B 7/04* (2006.01)

(52) U.S. Cl.
CPC ..... *E21B 11/02* (2013.01); *E21B 7/046* (2013.01)

(58) Field of Classification Search
CPC ..... E21B 7/046; E21B 11/02; E21B 19/15
See application file for complete search history.

(56) References Cited

U.S. PATENT DOCUMENTS 4,828,050 A * 5/1989 Hashimoto ..... E21B 7/062 175/45
6,085,852 A * 7/2000 Sparks ..... B65G 1/08 173/164
6,408,954 B1 * 6/2002 Price ..... E21B 19/15 175/52
6,736,219 B1 * 5/2004 White ..... E21B 7/046 173/152
9,669,855 B2 * 6/2017 Elliott ..... B62B 3/102
10,982,497 B1 * 4/2021 Herrick ..... E21B 17/16
2009/0014215 A1 * 1/2009 Hartke ..... E21B 7/046 175/52
2013/0028664 A1 * 1/2013 Cherrington ..... F16L 1/032 405/184

OTHER PUBLICATIONS

Marketing Material [online; retrieved Jun. 6, 2021] Company Name: Pow-r Mole Trenchless Solutions Product: PD-4, https://powrmole.com/PD46FLYER.pdf Company website: https://www.powrmole.com/bursting-and-boring.
Marketing Material [online; retrieved Jun. 6, 2021] Company Name:TT Technologies Product: Grundopit Company website:https://www.tttechnologies.com/products/grundopit-pit-launched-directional-boring-system/.
Marketing Material [online; retrieved Jun. 6, 2021] Company Name: Pride Engineering Company Product: Rod Pusher PN-20K Company website:https://www.dsc-pride.com/katalog/prokol-grunta/ustanovka-neupravlyaemogo-prokola-pn20k/?lang=en.
(Continued)

*Primary Examiner* — Shane Bomar
(74) *Attorney, Agent, or Firm* — Robin Kelson Consulting, Inc.

(57) ABSTRACT

A compact open-path horizontal trenchless pipe ramming device for short distance horizontal drilling and which accommodates off-the-shelf standard plastic or steel pipe stems in a range of pipe diameters. The device is lightweight and competent to retrieve a drill string and attached cable or replacement pipe.

8 Claims, 8 Drawing Sheets

(56) References Cited

OTHER PUBLICATIONS

Marketing Material (demonstration video) [online; retrieved Jun. 6, 2021] Source Name: Fijalo-Poland Product: Hydraulic Piercing Tool HMP-200 video url: https://www.youtube.com/watch?v=25NZrUYtKac.
Marketing Material (demonstration video) [online; retrieved Jun. 6, 2021] Company Name: unknown Product: "YNKT 30H" (directional boring device) video url: https://www.youtube.com/watch?v=IG4l3dDZKtw.
Marketing Material (demonstration video) [online; retrieved Jun. 6, 2021] Company Name: unknown Product: unknown (Russian rod pusher device) video url: https://www.youtube.com/watch?v=NaGDT1-U0QQ.

* cited by examiner

FIG. 9
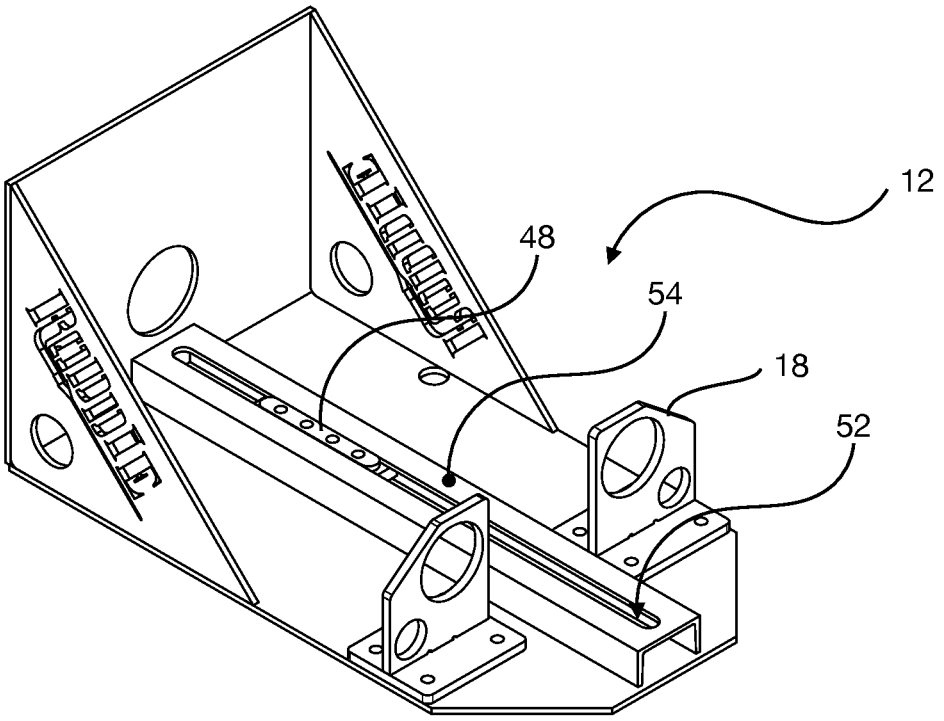
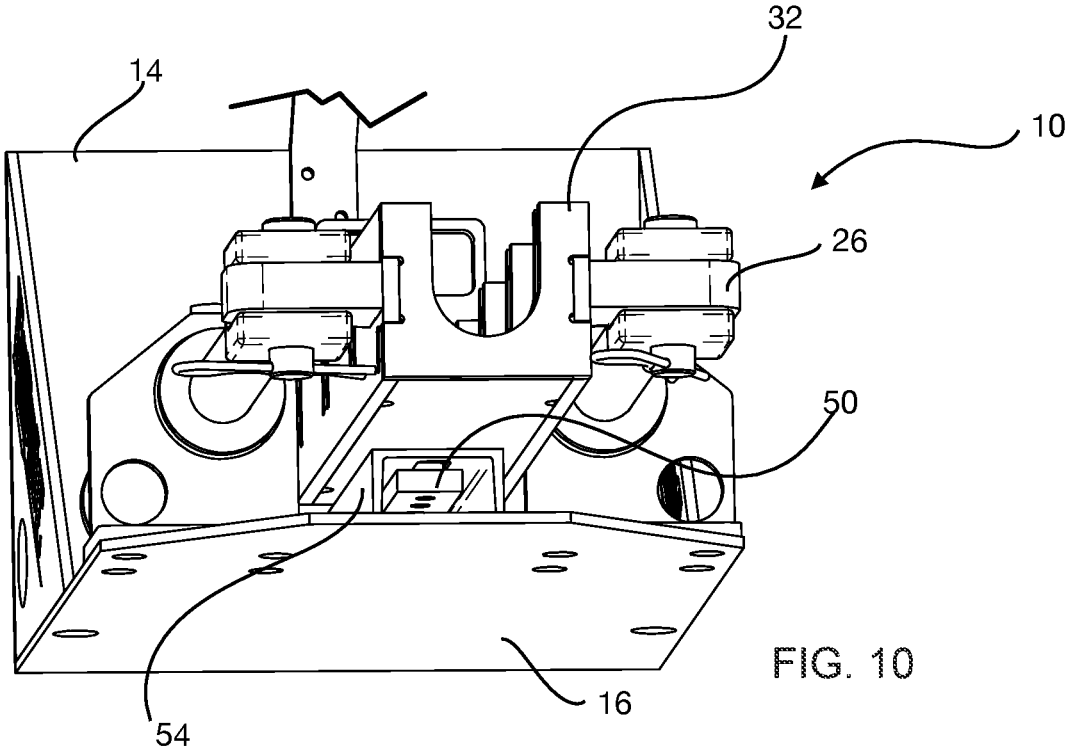
FIG. 10

OPEN PATH HORIZONTAL PIPE RAMMER FOR VARIABLE PIPE DIAMETER

CROSS REFERENCE TO RELATED APPLICATIONS

This application claims the benefit of Patent Application U.S. Ser. No. 62/987,222, filed Mar. 9, 2020, the disclosure of which is hereby expressly incorporated in its entirety by reference herein.

FIELD OF USE

Embodiments of the present disclosure find applicability in the field of trenchless horizontal directional drilling. One useful field includes systems for placing gas, water, sewer, or other underground pipes, and/or for laying cable underground, including electrical and fiber optic cable.

BACKGROUND

Directional drilling machines and methods of use are well-known and well-characterized in the art. Also referred to in the art as boring, thrusting or horizontal drilling, the technology allows for the laying of pipe and cable underground (e.g., gas, water, sewer and drain pipes; ducts; power cables, and the like) without needing to excavate or cut open the ground surface along the length of the pipe or cable to be installed. In "pit launched" applications, entry into the ground occurs from a first or "entry" access pit dug into the ground. For drilling distances on the order of 500 ft or less, and pipe or conduits of 8-inches or less, the drill or boring apparatus can be placed inside the pit, and drilling occurs substantially horizontally from the start. Directional boring machines are generally configured to drive a series of drill rods joined end-to-end to form a drill string. As needed, the drill string direction underground can be guided by means of a suitable geodetic instrument, including GPS locator instrumentation. At the drilling destination, a second access pit or "exit" pit typically is provided. Patent publications U.S. Pat. Nos. 6,109,831; 5,205,671; and WO 2013/055389 are representative of the art.

Small model trenchless directional drills (having pullback ratings of 20,0000 pounds or less), currently make up over 60% of the horizontal directional drilling market. Pit launch models, typically characterized by a hydraulic drive motor that sits in the entry pit to be operated from within the pit, are particularly attractive for operations requiring in the range of about 5,000-20,000 pounds of pullback, drilling lengths in the range of less than about 1,000 ft, and small diameter pipe (typically about 4-inches or less). TT Technologies, Pow-r Mole Devices, Inc., McGlaughlin Group, Inc., Ditch Witch and Roddie Inc., are representative of the companies providing small model directional drills for the horizontal directional drilling market.

Small model trenchless drilling or boring machines, devices or apparatuses typically move pipe through horizontal space underground in one of two ways: using forward thrust and pipe rotation, or forward thrust alone (also known as "pipe ramming"). The thrusting means can act to pull or push a pipe forward into the ground. For example, the male end of a drill stem can thread into the drive motor itself, and the rod can be pushed into the ground. Alternatively, a mechanism can be provided that engages the pipe outer circumference and pulls the pipe with it during the forward thrust motion. Often, the pulling engagement mechanism takes advantage of a groove on the pipe outer circumference.

It is common for trenchless horizontal drilling machines, including small model trenchless machines, to use proprietary drill stems with internal couplings, and dimensioned to fit that specific machine or apparatus, including having a specified length and diameter. For machines that use a pipe pulling engagement mechanism, the pipe stem also can include a groove or other surface modification required for engagement. The requirement to use the proprietary pipe with a device adds to the cost of the device.

While most small model trenchless drilling is performed by utility companies and contractors for installing or replacing pipe over a distance of 50 or more feet, it is not uncommon for plumbers, landscapers, electricians, communication installers and the like to have occasion to install or replace pipe (for irrigation or cable, for example) across short distances, such as the width of a driveway or sidewalk (namely, typically in the range of about 3-35 feet or so). Generally, these service industries will not own a small model trenchless drilling device, in part due to the cost of the machine and pipe stems, and so will need to contract out the short-distance drilling to a trenchless drilling provider, at an added cost to the customer or, if this is too costly, resort to trenched installations. It would be advantageous to have, and there remains a need for, an affordable, lightweight, small model trenchless drilling device for short-distance horizontal drilling that does not require proprietary pipe stems, allowing the operator to purchase off-the-shelf pipe stems and associated hardware, that accommodates both metal and plastic pipe stems, and that also allows for a range of pipe stem diameters.

The present disclosure describes improvements in small model horizontal directional drilling machines, apparatuses, devices, mechanisms, components and methods of use thereof that uses off-the-shelf, non-proprietary pipe stems, allows for a range of pipe stem diameters and materials, and overcomes deficiencies in the devices, machines, apparatuses, components mechanisms and methods of the prior art.

SUMMARY

This summary is provided to introduce a selection of concepts in a simplified form that are further described below in the Detailed Description. This summary is not intended to identify key features of the claimed subject matter on its own, nor is it intended to be used on its own as an aid in determining the scope of the claimed subject matter.

In accordance with one embodiment of the disclosure, provided herein is a novel horizontal trenchless pipe ramming device. The device is an "open path" device that does not require pipe lengths to be threaded on to the device or through an opening. In another embodiment, the device accommodates off-the shelf pipe stems or standard "push rods" in a range of pipe diameters that can be composed of plastic or steel. In one embodiment, the device comprises (1) a chassis that includes means for pushing the pipe stem forward into the ground during the machine's forward thrust motion, and (2) a staging tray for holding the pipe stem. In another embodiment the device comprises a multi-stage mechanism for moving the pipe stem forward. In still another embodiment, the staging tray comprises a plurality of pipe saddles or cradles for holding the pipe stem, the cradles dimensioned to receive a desired pipe stem outer diameter. In still another embodiment the pipe saddle radii can be modulated to accommodate a range of pipe diameters, including, without limitation, pipe diameters in the range of about 1-inch to 2-inch. In yet another embodiment, the staging tray engages the chassis by means of a coupling mechanism that minimizes lateral movement of the tray or the pipe during the forward thrust or pipe ramming motion. In still another embodiment, the device or machine is competent to retrieve a drill string of coupled drill stems or push rods, and can be used to install larger pipe, replacement pipe or cable, using proprietary or standard, off-the shelf pipe stems, pipe couplers, and hardware, including small scale tracking devices.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein:

FIG. 9 is a top perspective view of a pipe ramming device chassis according to one embodiment of the instant disclosure;

FIG. 10 is a bottom perspective view of a pipe ramming device according to one embodiment of the instant disclosure;

DETAILED DESCRIPTION

Figure 1:
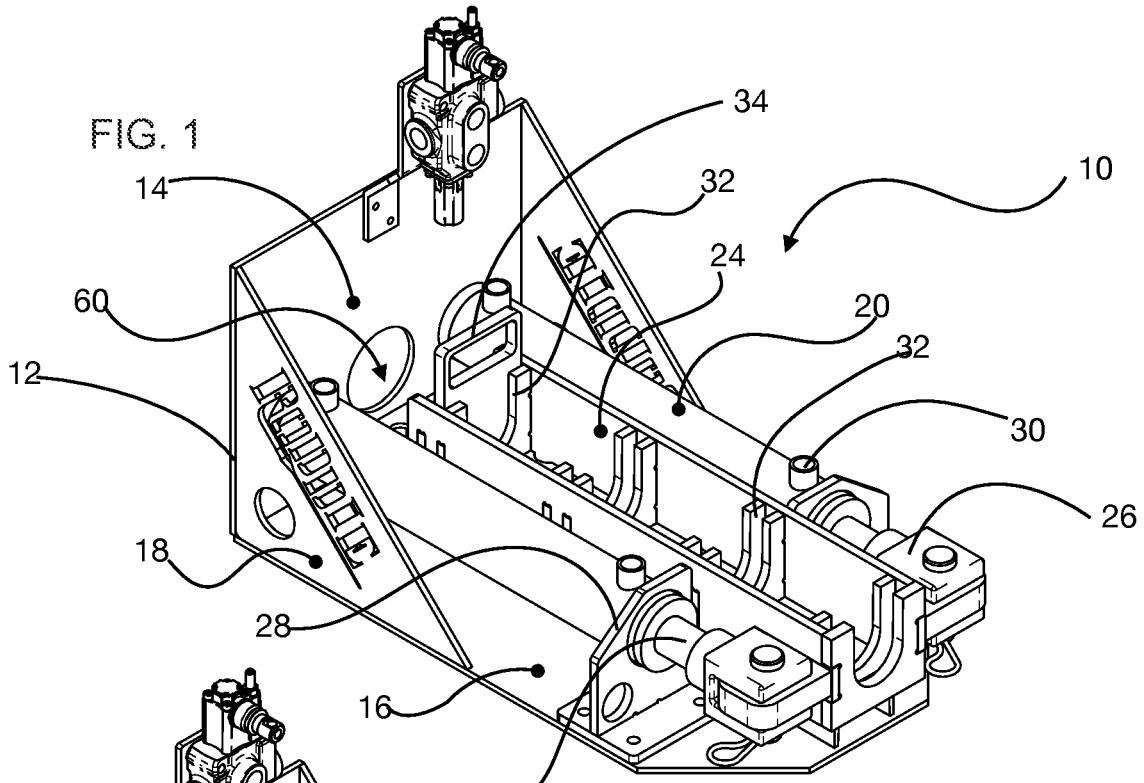
FIG. 1 illustrates a pipe ramming device in accordance with one embodiment of the instant disclosure with piston rods in the retracted position.
Figure 2:
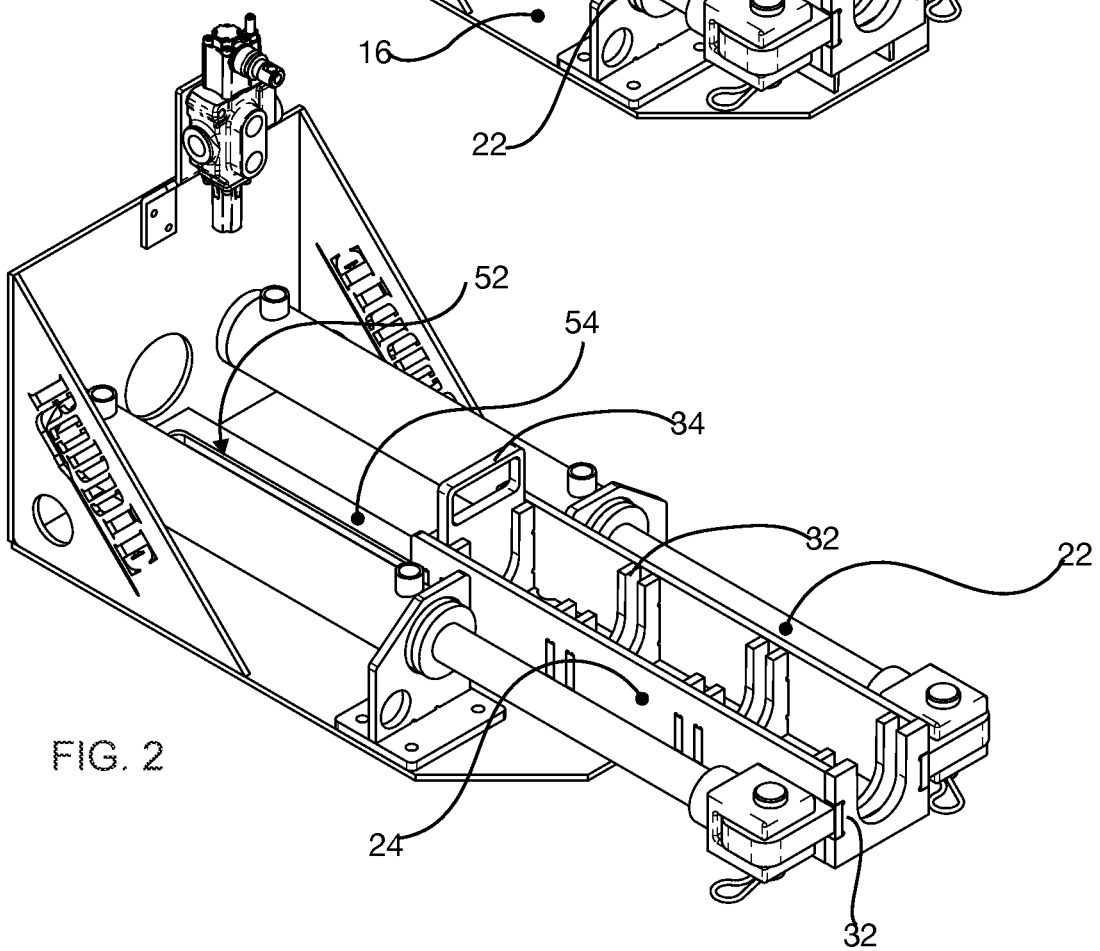
FIG. 2 illustrates a pipe ramming device in accordance with one embodiment of the instant disclosure with piston rods in the extended position.
Figure 3:
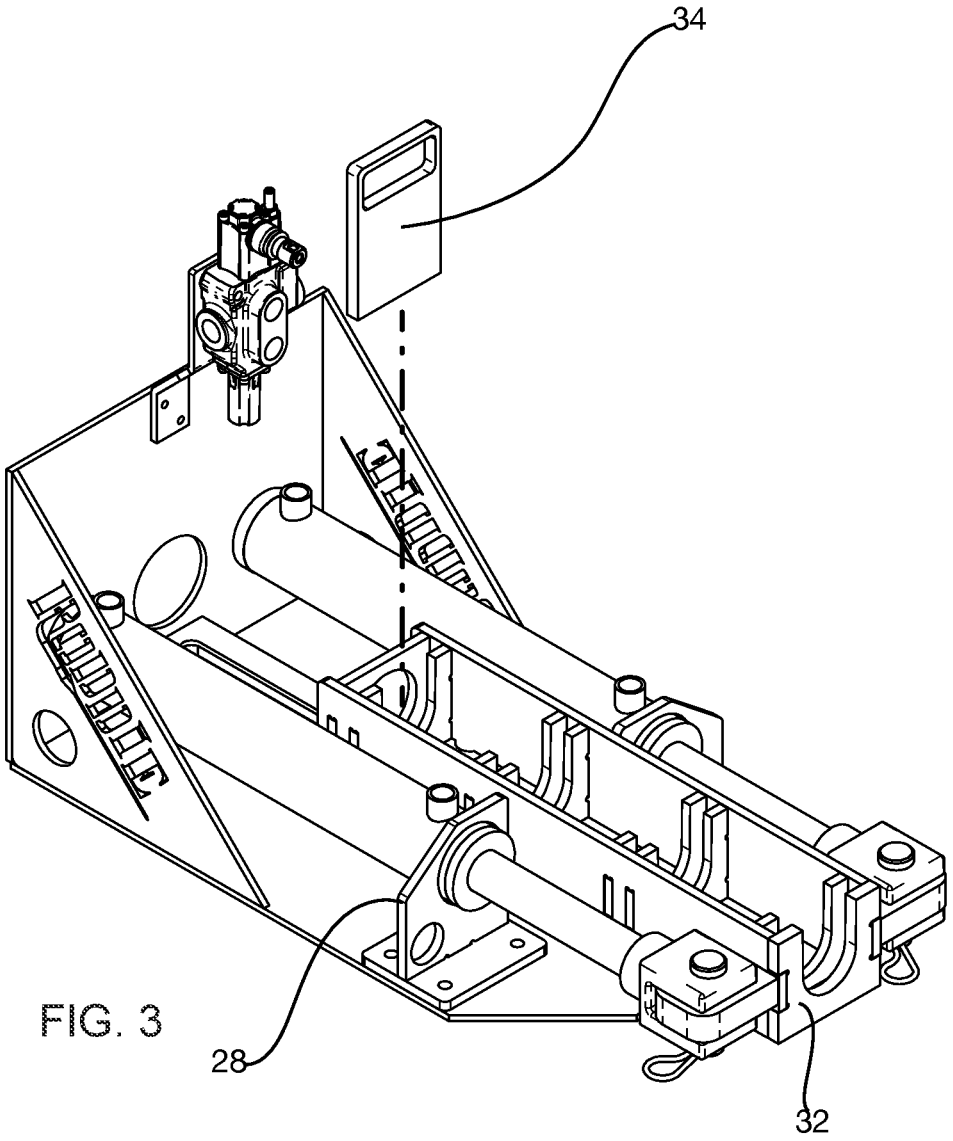
FIG. 3 illustrates an exploded view of a pipe ramming device in accordance with one embodiment of the instant disclosure.
Figure 4:
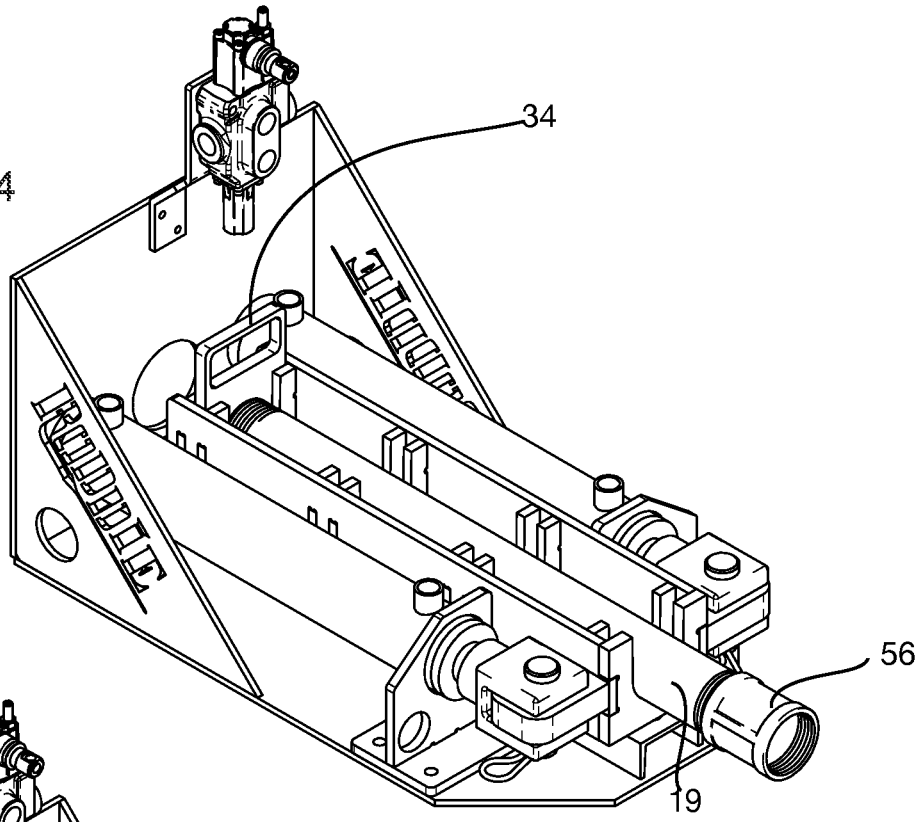
FIG. 4 illustrates a pipe ramming device in accordance with one embodiment of the instant disclosure with a pipe stem and coupler and piston rods in the retracted position.
Figure 5:
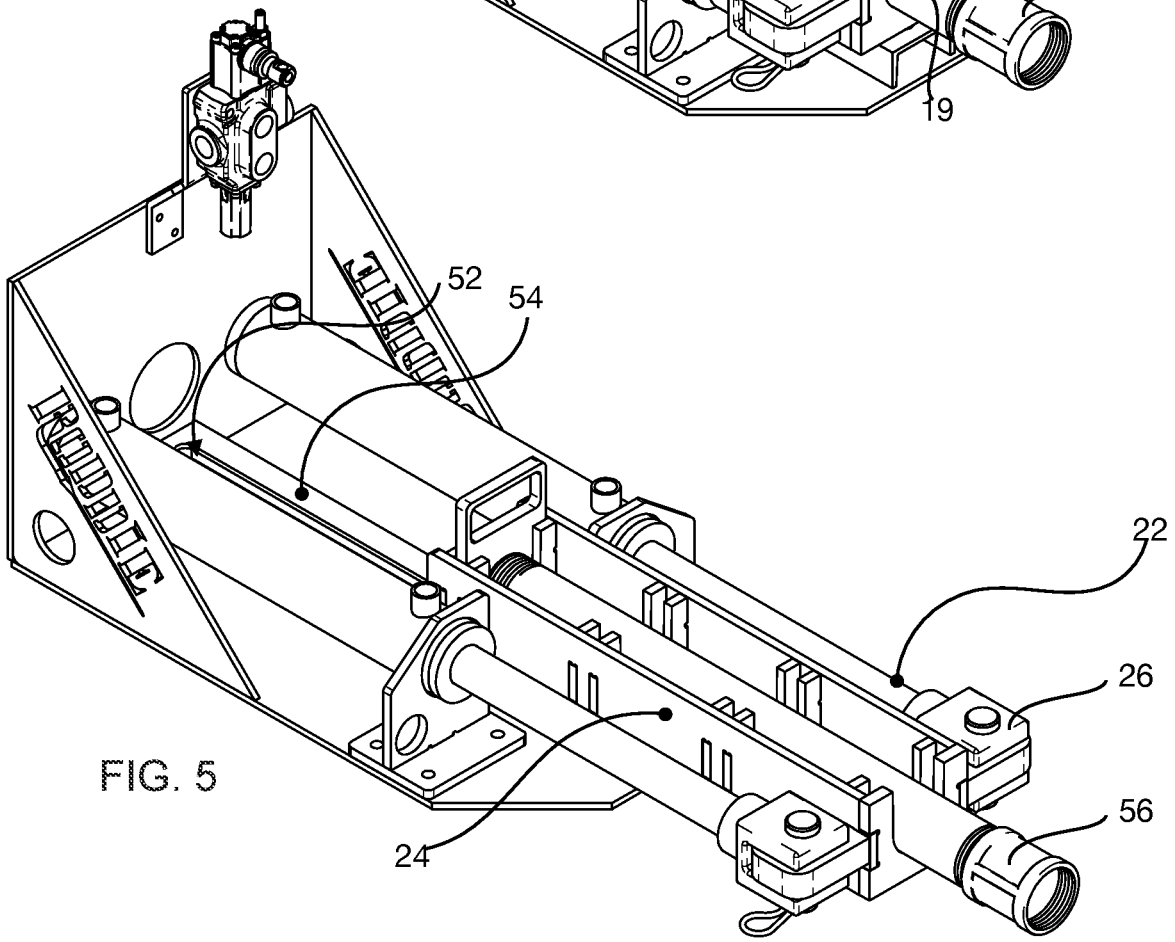
FIG. 5 illustrates a pipe ramming device in accordance with one embodiment of the instant disclosure with a pipe stem and coupler and piston rods in the extended position.

Embodiments of the present disclosure provide devices, machines, apparatuses, components, mechanisms and methods of use directed to improved means for short-distance horizontal pipe ramming through space underground using standard, non-proprietary pipe stems or push rods.

The open-path, short-distance horizontal ram pusher disclosed herein provides a compact, lightweight, portable machine or apparatus for creating bores underground using standard, off-the-shelf pipe stems, also referred to herein as "push rods". The device also allows the operator access to a range of pipe diameters in a single machine.

Referring to FIGS. 1-5 and 14, a pipe ramming device 10 (also referred herein as an apparatus or machine), is illustrated. The device comprises a chassis component 12 and a staging tray 24, competent to hold a pipe stem 19 to be pushed substantially horizontally into the ground. Chassis component 12 can comprise a frame competent to hold a pair of parallel, opposing piston cylinders 20, which, together with the pistons and rods held therein, provide the thrust means for pushing the staging tray forward. Advantageously, the staging tray can be coupled to piston rods 22 by any standard coupler means 26. In the exemplary, non-limiting figure examples, coupler means 26 comprise standard bolt and pin means. As piston rods 22 are extended out of cylinders 20, for example using standard hydraulic fluid means provided to the cylinders via standard hydraulic couplers 30, staging tray 24 can be pulled forward and, with it, pipe 19.

Chassis component 12 can include standard means for securing piston cylinders 20 in a parallel, substantially horizontal position. Examples include piston brackets 28 and, advantageously, a chassis back plate 14. Chassis side bracing means, such as side braces 18, also can be included for stability. Chassis component 12 also can include means for engaging staging tray 24, providing for example, means for limiting lateral movement of the tray and pipe during the forward thrust operation. One exemplary, non-limiting engagement means illustrated in FIGS. 2, 5, and 9, includes a groove 52, which can be provided on an elevated track 54 attached, for example, to floor plate 16. Groove 52 can provide means for engaging a rudder or "T-slide" engagement means 46 extending down from the undersurface of staging tray 24 (see, e.g., FIGS. 7 and 8). Chassis floor plate 16 also can provide ready means for securing piston securing brackets 28, and means for stabilizing apparatus 10 in a substantially horizontal position.

Figure 14:
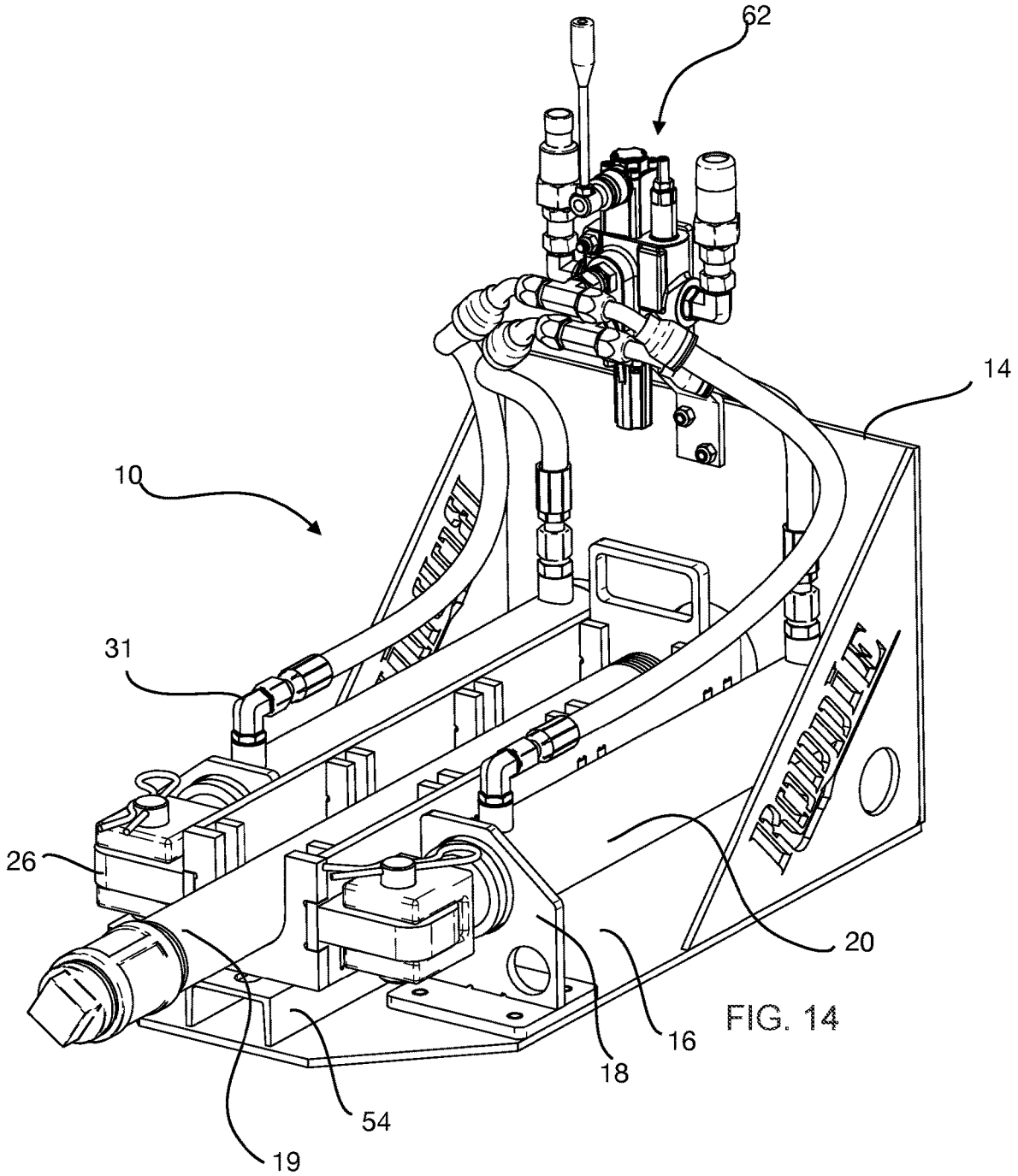
FIG. 14 is a perspective view illustrating a pipe ramming device according to one embodiment of the instant disclosure.

As illustrated in FIG. 14, a hydraulic valving control mechanism 62 advantageously can be associated with chassis component 12 including, as illustrated, by attachment to chassis back plate 14.

Staging tray 24 can comprise an open container that allows a pipe length to be placed into the tray from above, rather than slid or threaded into the tray laterally or horizontally. This means the top and front end of tray 24 are open. Typically tray 24 is shorter than the full length of pipe stem 19. Additional key features of tray 24 can include comprising means for coupling tray 24 to the forward thrusting means of device 10; means for holding pipe stem 19 in a substantially horizontal position, and means for pushing pipe stem 19 forward during the thrusting operation. Advantageously, staging tray 24 also can comprise means for accommodating multi-stage positioning of pipe stem 19; means for accommodating a plurality of pipe stem widths, and means for limiting lateral movement of tray 24 and therefore pipe 19 during the thrusting operation.

Non-limiting, exemplary staging tray 24 features are highlighted in FIGS. 1-10 and particularly FIGS. 6-10. As stated above, one non-limiting example of means for coupling tray 24 to the forward thrusting means of device 10 can include coupler means 26, which can extend laterally from the sides of tray 24 and bolt to piston rod 22. A series of pipe saddle braces 32 can be provided along the length of tray 24 to hold pipe stem 19 in position. Preferably, the pipe saddle brace cradle has a dimension and radius that can accommodate and mirror the pipe exterior radius or circumference such that pipe stem 19 sits in the brace's saddle or cradle. As illustrated in the figures, pipe saddle brace spacing along the length of tray 24 also can be used to hold and support a positionable ram plate 34. Ram plate 34 can provide a back plate for pipe stem 19, effectively pushing pipe 19 forward into the ground during the device's forward thrust operation. As illustrated in the figures, the plate support function of the saddle braces can be achieved with a pair of saddle braces separated by an appropriate distance, creating a slot 33 dimensioned to accommodate and hold the positionable plate.

Figure 11:
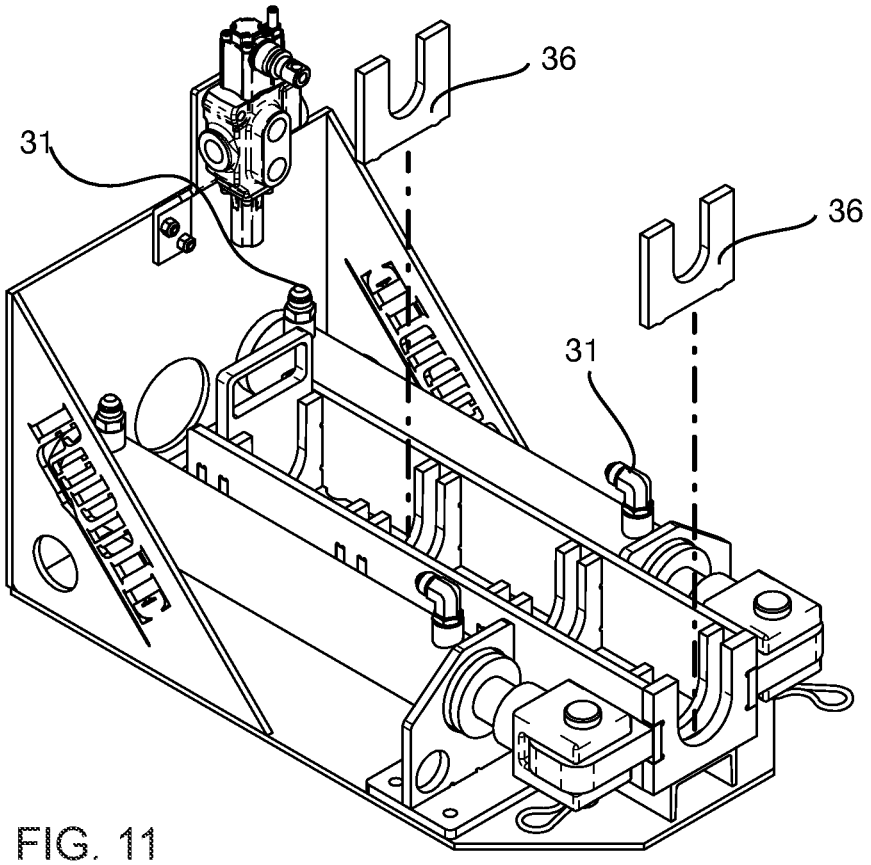
FIG. 11 is an exploded view of a pipe ramming device according to one embodiment of instant disclosure and illustrating exemplary pipe diameter modulating saddles.

Staging tray 24's ability to accommodate a plurality of pipe diameters is advantageously accomplished using the saddle brace support function described herein above. For example, the saddle brace pairs described herein and illustrated in the figures, including FIGS. 6 and 11, as well as saddle brace placement relative to the front and back of staging tray 24 can provide slots or spacings 33 that support placement of modulating pipe diameter saddles 36. Modulating pipe diameter saddles 36 define a cradle spacing having an inner radius dimensioned to accommodate and receive a pipe diameter smaller than that accommodated by saddle brace 32. Placing modulating pipe diameter saddles having a desired cradle inner radius in slots 33 of staging tray 24 allows staging tray 24 to receive and hold pipe stems of smaller diameter without undue lateral movement of the pipe during operation. In this way, staging tray 24 and device 10 can accommodate a plurality for pipe diameters.

For example, the cradle inner radius of saddle braces 32 can be dimensioned to accommodate a 2-inch diameter pipe. A series of modulating pipe diameter saddles 36 can be fabricated having cradles with inner radii of, for example, 1.5-inch; 1.25-inch and 1-inch, allowing for 4 different pipe diameters to be utilized. The operator can readily determine the number of modulating pipe diameter saddles 36 that best support a pipe stem during operation. In general, at least two and, if desired three or more saddles 36 can be strategically placed along the length of staging tray 24. For example, where a 1-in pipe is desired to be used in a staging tray that accommodates a 2-in diameter pipe, 1-in accommodating modulating pipe diameter saddles 36 can be placed in slots 33 at each of the front and back of staging tray 24 and, if desired, a third saddle 36 can be placed in an interior tray slot 33.

Figure 7:
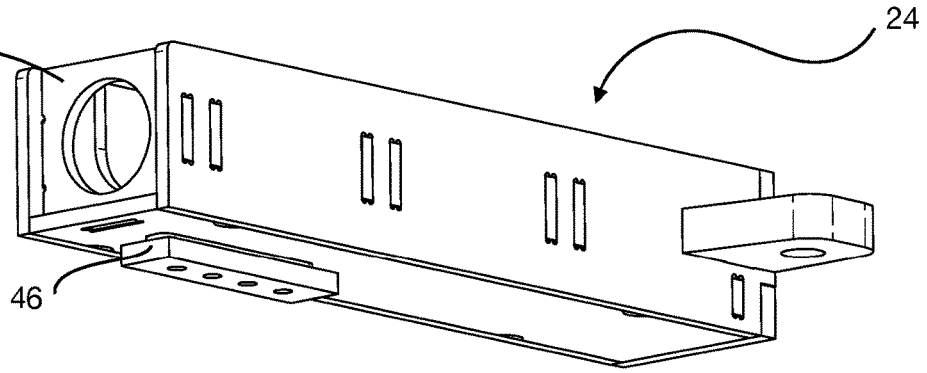
FIG. 7 is a bottom perspective view of a staging tray according to one embodiment of the instant disclosure.
Figure 8:
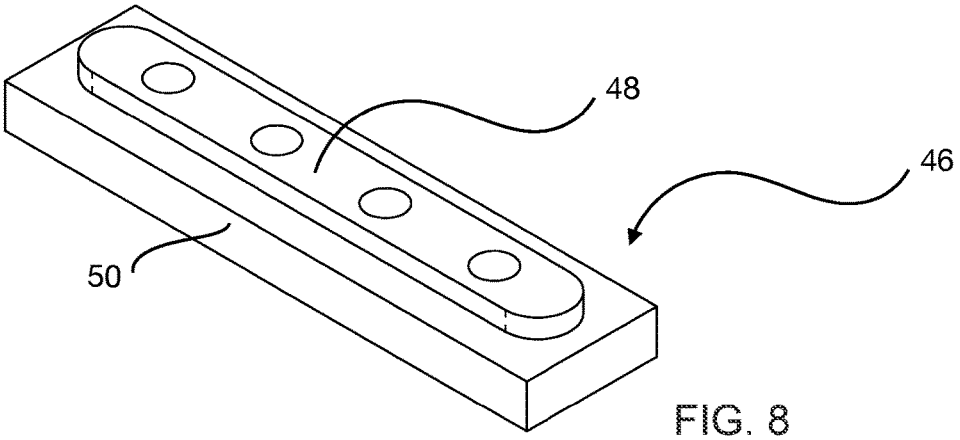
FIG. 8 illustrates an exemplary T-slide or staging tray rudder according to one embodiment of the instant disclosure.

As illustrated in FIGS. 7, 8 and 10, staging tray 24 advantageously can be coupled to chassis component 12 to minimize lateral movement of tray 24 and pipe 19 during operation. As described hereinabove, one non-limiting means can include a slide or rudder or tongue 46 that extends down from the bottom surface of tray 24 and engages in groove 52 on chassis component 12. In one embodiment, groove 52 can occur in an elevated track 54 secured to chassis floor plate 16. Advantageously, rudder 46 can comprise an upper component comprising means for securing the rudder to staging tray 24 and dimensioned to pass through and slide along groove 52, as well as a lower component 50 dimensioned to limit upward movement of rudder 46 through groove 52. In one non-limiting embodiment, for example, lower component 50 can have a width greater than that of groove 52. In this example, rudder 46 can be referred to as a "T-slide". During operation, as piston rod extension moves staging tray 24 forward along chassis 12, rudder 46 slides forward in groove 52, the groove width limiting lateral movement of tray 24.

As described in the Examples below, during forward thrusting operation, pipe ramming device 10 typically sits in an opening below the ground surface and pipe stem 19 is pushed forward into the ground in a substantially horizontal direction and away from back plate 14. As pipe stem 19 is pushed substantially horizontally into the ground, a second pipe stem can be threaded on to the exposed end of the first buried pipe stem, for example by means of a threaded coupler 56, forming a coupled pipe string, and the second pipe stem then pushed into the ground.

As illustrated in Example 4 below, the ramming device of the instant disclosure also can advantageously be used to retrieve a buried pipe string using a pulling action. Here, device 10 is turned 180 degrees in the below ground opening so that back plate 14 is adjacent the ground wall into which the pipe string has been buried. Opening 60 in back plate 14 is positioned and dimensioned such that pipe stem 19 can pass through back plate 14 into staging tray 24. The free end of the buried pipe string then is engaged or otherwise coupled to the staging tray, and the piston cylinders activated, which pulls the string out of the ground and into device chassis area.

Figure 12:
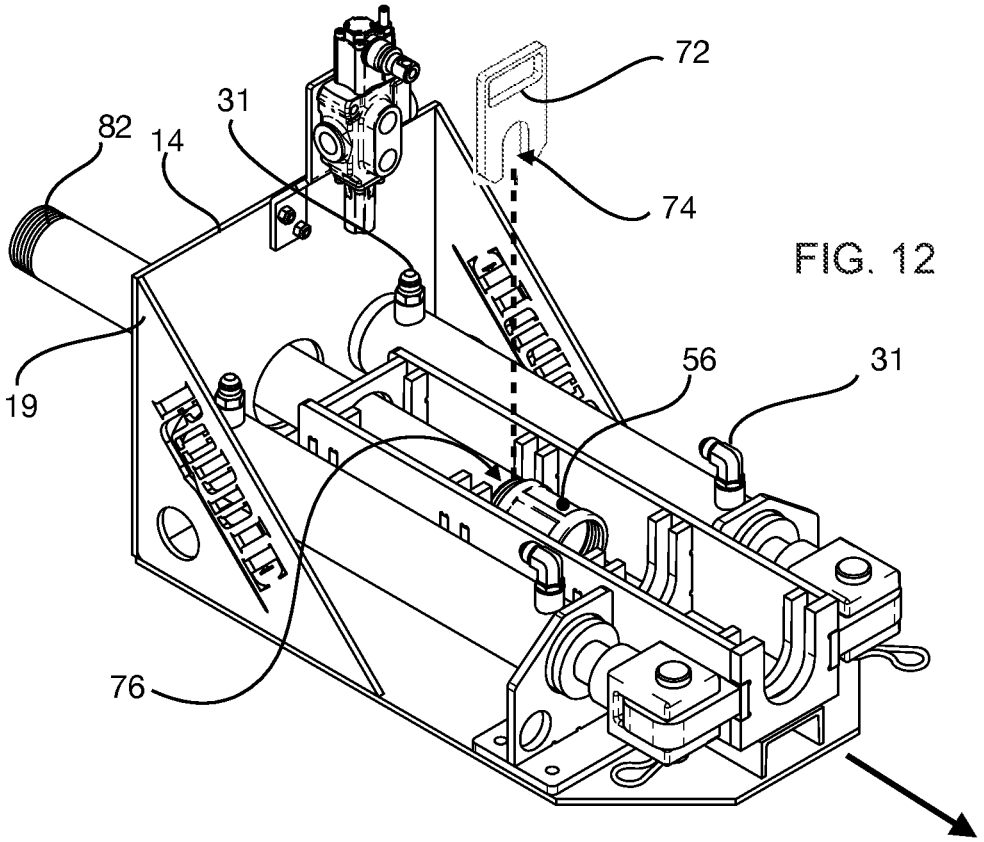
FIG. 12 illustrates a pipe ramming device according to one embodiment of the instant disclosure configured for pipe string retrieval.

FIG. 12 illustrates one non-limiting example for coupling or engaging a standard pipe string free end for pipe string retrieval. In the figure, a coupler 56 is attached to the pipe string free end. A modified ram plate 72 (hereinafter referred to as a "stop plate") is provided. Stop plate 72 can have a spacing 74 on its lower edge dimensioned to mirror and accommodate the pipe stem outer surface diameter such that stop plate 72 can straddle the pipe stem, while being insufficient to straddle the coupler. Placing stop plate 72 in a brace slot 33 so that stop plate 72 straddles pipe stem 19 at a position 76 aft of coupler 56, the pipe string now is coupled to staging tray 24. As tray 24 is pulled "forward", away from back plate 14, the engaged pipe string is pulled forward into the device chassis area and out of the ground. As will be appreciated by those having ordinary skill in the art, where proprietary pipe stems are utilized in place of standard, off-the-shelf pipe stems, an independent coupler 56 may not be needed. Proprietary pipe stems typically have an integrated coupling means. In the event that the coupling means does not create a larger diameter surface than that of the pipe stem itself, pipe stem stop plate position 76 can comprise a perimeter groove having a smaller diameter than that of the pipe stem outer diameter, the groove diameter mirroring stop plate spacing 74.

Figure 13A:
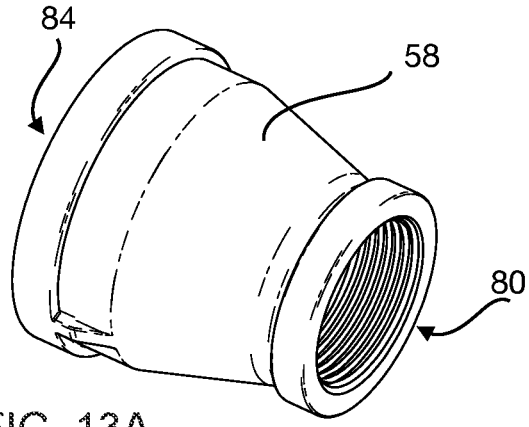
FIGS. 13A and 13B illustrate exemplary standard bell reducing couplers.
Figure 13B:
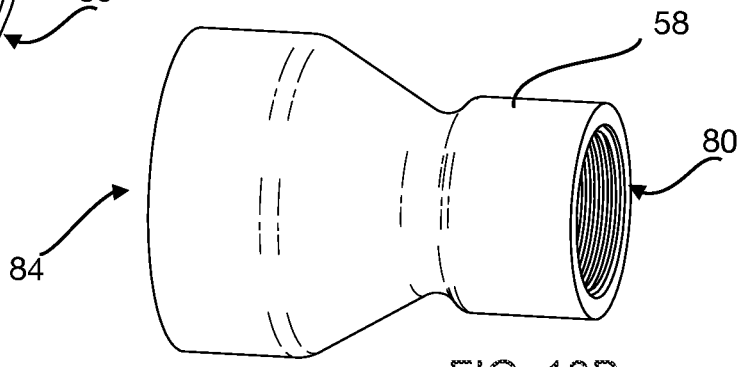

Pipe ramming device 10 also can be used to pull back a larger diameter pipe or conduit than that of pipe stem 19. As illustrated in Example 4 below and FIGS. 12-13B, the device of the instant disclosure also allows replacement or larger diameter pipe to be pulled through the horizontal bore hole created by the pipe ramming device 10. FIGS. 13A and 13B illustrate non-limiting examples of off-the-shelf materials that can be coupled to an exposed free pipe stem end 82. In the figures two bell reducers 58 are illustrated, each having a front end 80 that can couple to pipe stem end 82, and having a smaller diameter than bell reducer flared back end 84. Bell reducer back end 84 can be coupled to a replacement pipe or conduit using standard coupling means. As the pipe string is pulled back through the ground, the attached bell reducer enlarges the bore hole created by the pipe string, creating a larger opening for the replacement or larger diameter pipe to be pulled through.

If desired, using standard hardware and coupling means, a tracking device also can be engaged to the front end of the first pipe stem at the start of the forward pipe ramming operation, taking advantage of opening 82 in the pipe stem. (See, e.g., FIG. 12).

Pipe ramming device 10 also can accommodate a cable gripping mechanism in the event it is desired to use the device to pull cable. In one preferred example, a modular cable gripping mechanism is used, preferably one that can be fitted into an open space in staging tray 24, for example in the opening defined by reference number 78 in FIG. 6. One exemplary, non-limiting example of a useful modular cable gripping mechanism is the mechanism disclosed in U.S. Ser. Nos. 16/386,250 and 16/443,850, co-owned by the instant assignee, the disclosures of which are incorporated herein in their entirety by reference.

As will be appreciated by those skilled in the art, fabrication considerations for the chassis and staging tray are standard considerations readily determinable by a fabricator having ordinary skill in the art. For the chassis, the considerations can include the standard pipe stem length to be accommodated, (e.g., 2-ft); the dimensions of the piston, cylinder and rods and desired thrust power; and fabrication materials that accommodate desired stability, strength and overall weight. Where 2-ft pipe lengths are used having diameters in the range of about 2-inches, the overall length of the chassis can be in the range of about 24 inches, and the chassis can function with a width in the range of about 15 inches. Thrusting power in the range of about 15,000 lbs can be achieved using a standard skid steer, excavator, power pack or the like.

For the staging tray, standard fabrication considerations can include: (a) providing a width dimension that accommodates the desired maximum pipe diameter; (b) providing a length dimension sufficient to hold the desired pipe length horizontal during the pushing operation and that accommodates the desired piston cylinder and rod dimensions for a desired thrust power; (c) fabricating pipe saddle braces to accommodate positionable ram plate 34 at the forward staging position (extended staging position 2, illustrated in FIG. 2); and providing a ram plate means at staging position 1 (retracted staging position 1, illustrated in FIG. 1). Advantageously, ram plate means at staging position 1 can be provided by means of a positionable ram plate 34 that can be held in position by means of a pipe saddle brace 32. Alternatively, staging tray back plate 42 (see, e.g., FIG. 6) could act as a staging position 1 ram plate.

Advantageously, and as illustrated in FIG. 1, providing a plurality of pipe saddle braces at staging position 2 accommodates a range of ground or soil conditions, and provides the operator flexibility in positioning ram plate 32 at the extended, stage 2 position. In addition, the number and placement of pipe saddle braces 32 can be selected based on the number of braces determined to best hold pipe 19 in position in tray 24. As illustrated and described herein above, placing a pair of braces 32 in tandem can create a slot 33 for holding ram plate 34 and/or pipe diameter modulating saddles 36 as desired.

The machine can be constructed to accommodate standard length pipe, including, without limitation, 2-ft pipe; provide thrust power in the range of up to about 15,000 lbs., and can deliver a pipe string horizontally underground for distances at least in the range of about 3-50 ft. The machine design is lightweight and compact. When fabricated for standard 2-ft pipe, the machine's overall length can be in the range of about 24-inches, with a width in the range of about 15 inches, and can have an overall weight in the range of about 120 lbs or less.

Examples

The examples which follow make reference to components illustrated in the figures described above. It will be appreciated that the order of operations or acts described sequentially in the examples that follow may in some cases be rearranged or performed concurrently.

1. Pipe Ramming Operation—Under Sidewalk.

Referring to the figures, entrance and exit pits are dug on opposite edges of a sidewalk under which a pipe or cable passthrough or chase is desired, and a machine 10 is provided to the entrance pit. Useful pit dimensions need only accommodate 1.5 times the pipe stem length and be wide enough to accommodate the machine itself. Pit depth will depend on the depth of a desired passthrough or chase. Where the machine is fabricated to accommodate 2-ft pipe stems, a pit length in the range of about 3 ft can be dug, for example. In this example, machine 10 is placed in the entrance pit such that chassis back plate 14 rests against the back end of the entrance pit, which provides a brace against which the machine can push during the thrusting operation. If desired, additional bracing support can be provided between the machine and back pit wall.

Hydraulic cables are attached to hydraulic valve couplers 30 via quick connect couplers 31 (See, e.g., FIGS. 12 and 14), and power is provided to the system via an excavator, skid steer, power pack or the like. A standard, off-the shelf, galvanized 2-ft pipe stem 19, externally threaded at both ends, is placed in staging tray 24, preferably with one end adjacent the back end of the staging tray or positionable ram plate 34 associated therewith. If desired, an internally threaded, standard, off-the-shelf pipe coupler 56 can be threaded onto the front end of pipe stem 19.

Pipe Ram Staging Step #1. At the start of the operation piston rods 22 are in the retracted, "stage 1" position. Valving mechanism 62 is activated to extend piston rods 22 forward from cylinders 20. As rods 22 extend forward, tray 24 is pulled forward, and pipe stem 19 is pushed forward into the ground. When piston rods 22 are in the fully extended "stage 2" position, staging tray has been moved forward to the "stage 2" position, typically about 14 inches forward, and the front end of pipe stem 19 has now entered the ground and will be held there. Valving mechanism 62 now is activated to retract piston rods 22 to their stage 1 position, pulling open path staging tray 24 back with it. Pipe stem 19 stays in the ground. When rods 22 and staging tray are back in the retracted, stage 1 position, the back end of pipe stem 19 now is about 14 inches forward in the retracted tray.

Pipe Ram Staging Step #2. Positionable ram plate 34 then is moved forward to an interior slot 33 formed by pipe saddle braces 32 and closest to the back end of pipe 19 that now resides towards the center of tray 24. Valving mechanism 62 is activated again to extend rods 22 to the stage 2 position again. As staging tray 24 is pushed forward, ram plate 34 pushes against the back free end of pipe stem 19, thrusting or ramming pipe stem 19 fully forward into the ground, leaving a short section the pipe's externally threaded back end exposed.

Valving mechanism 62 is activated again, retracting rods 22 and staging tray 24 to the retracted, stage 1 position. Ram plate 34 is returned to the back of tray 24, and a new pipe stem is placed in the tray. A coupler is threaded between the front end of new pipe stem 19 and the exposed back end of the embedded stem, forming a pipe string. If desired, glue can be added to the coupler threading for a more permanent seal.

Pipe Ram Staging Steps #1 and #2 are repeated, and now two pipe lengths have been thrust or bored underground. Most sidewalks are about 4 ft wide, and useful chase or passthrough pipe distances would likely comprise a drill string of 3-5 2-ft coupled pipe stems.

2. Pipe Chase—Under Sidewalk.

The pipe string installed in Example 1 can be used as a chase through which a narrower gauge pipe, such as irrigation pipe or fiber optic cable, now can be threaded.

3. Plastic Pipe—Under Sidewalk.

The pipe string embedded in the ground in Example 1 can act as a lead for installing a permanent plastic pipe. A standard plastic (e.g., PVC) pipe stem, typically of the same diameter and length, can be threaded to the back end of the embedded galvanized metal pipe, and pipe ramming staging steps 1 and 2 repeated until a plastic drill string of the desired length now is embedded and replaces the original metal pipe string. Because the galvanized pipe has done the work of creating the bore, moving plastic pipe through the bore can be accomplished easily and without risk of damaging plastic pipe.

4. Conduit, Replacement or Larger Diameter Pipe—Under Sidewalk.

The pipe string embedded in the ground in Example 1 now can be used to pull back through a conduit or larger diameter pipe (e.g., up to about 4-inch pipe). In this example, the free pipe end in the exit pit is coupled to the conduit or larger diameter pipe to be pulled back through. If the pipe to be pulled through is of a larger diameter, a standard, off-the-shelf expanding coupler such as a reducing bell coupler 58 (see, e.g., FIGS. 13A, 13B) can be attached to the pipe stem front free end in the exit pit; the coupler free end then can be capped using standard hardware, and a bolt hole and pin provided (for example) to couple the cap (or bell reducer itself) to the larger gauge pipe or conduit to be pulled back through.

Figure 6:
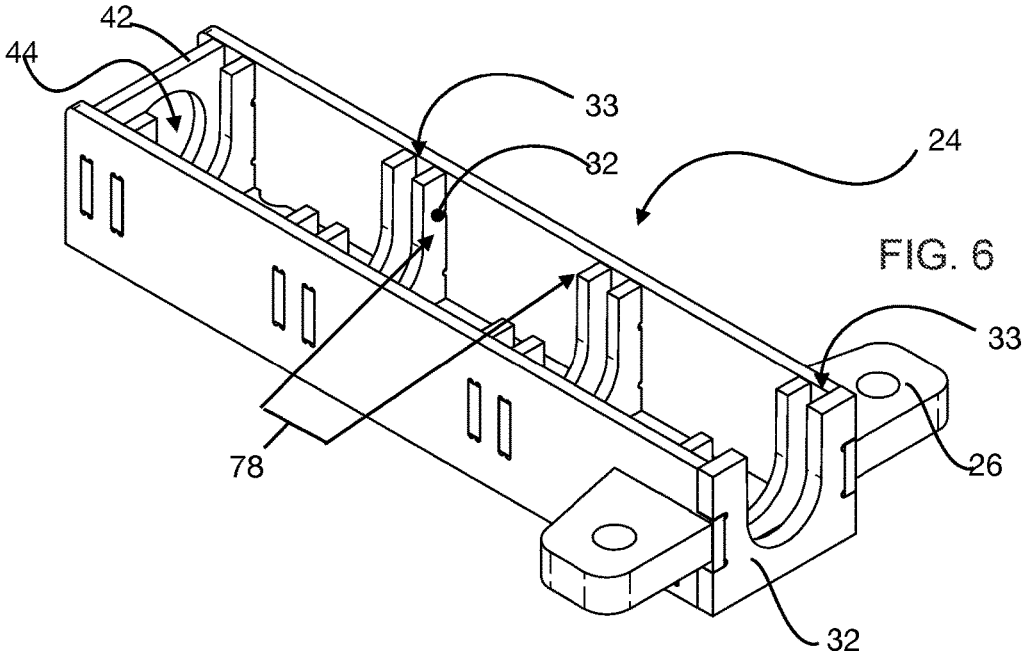
FIG. 6 is a top perspective view of a staging tray according to one embodiment of the instant disclosure.

At the entrance pit, machine 10 is turned around so its chassis back plate 14 now is adjacent the front end of the entrance pit. In this case, chassis back plate 14 will have an opening 60 (see, e.g., FIG. 1) large enough to accommodate the pipe string and, ideally, any larger gauge pipe or conduit being pulled through. Similarly, staging tray back plate 42 also preferably is configured to accommodate the pipe string to be pulled through, for example, by means of an aperture 44, as illustrated in FIG. 6.

FIG. 12 illustrates machine 10 configuration in the "reverse pull back" position. When machine 10 is turned around and chassis back plate 14 is adjacent the entrance pit front wall, the free back end of the drill string will extend into machine 10 and staging tray 24. A standard coupler or cap 56 can be threaded onto the free back end to enlarge the pipe end diameter sufficiently that the pipe end will not pass through the saddle brace opening.

The valving mechanism now is activated, pulling staging tray 24 forward into the pit and, with it, the drill string, because cap 56 holds the pipe string against a saddle brace. When rods 22 and tray 24 are in the extended, stage 2 position, cap 56 is unscrewed, and rods 22 and tray 24 returned to their retracted, stage #1 position. The partially embedded pipe string will remain in position. Cap 56 then is reattached, and the tray and rods extended again. Cap 56 will stop against the first available saddle brace, and the extension thrust action will pull the pipe string further into the pit together with the tray and rods. In this way the original drill string can be pulled into the pit and behind it the desired coupled conduit and/or larger pipe. It will be appreciated by those of ordinary skill in the art that, as drill stems get pulled into the pit, they are uncoupled, and cap 56 gets attached to the newly available pipe string free back end.

Embodiments of this disclosure may be embodied in other specific forms without departing from the spirit or essential characteristics thereof. The present embodiments are therefore to be considered in all respects as illustrative and not restrictive, the scope of the disclosure being indicated by the appended claims rather than by the foregoing description, and all changes that come within the meaning and range of equivalency of the claims are therefore intended to be embraced therein. While illustrative embodiments have been illustrated and described, it will be appreciated that various changes can be made therein without departing from the spirit and scope of the disclosure.

The embodiments of the invention in which an exclusive property or privilege is claimed are defined as follows:

1. A machine for pushing pipe horizontally through space underground comprising:

(a) a chassis component comprising a pair of parallel, horizontally positioned piston cylinders with extendable, hydraulically controlled piston rods, and, coupled to said extendable piston rods, (b) a staging tray comprising an open path cradle dimensioned to receive a standard dimensioned pipe stem to be pushed horizontally, said cradle comprising a plurality of slots for receiving a positionable ram plate such that, when said ram plate is in a said slot and in contact with a free end of said pipe stem in said cradle and said piston rods are extended, said staging tray and said cradled pipe stem are moved forward horizontally.

2. The machine of claim 1 further comprising a sliding track coupling said staging tray with said chassis, such that lateral movement of said tray is minimized when said piston rods are extended and said tray is moved forward horizontally.

3. The machine of claim 1 further comprising a plurality of positionable pipe diameter modulators dimensioned to engage with said cradle slots, said modulators dimensioned to receive a pipe circumference and having an inner radius less than that of said cradle.

4. The machine of claim 1 comprising at least two said cradle slots.

5. The machine of claim 1 further being competent to pull said pipe horizontally through space.

6. The machine of claim 5 comprising a positionable stop plate dimensioned to fit in said cradle slots and straddle a said pipe stem but not a coupler attached to a free end of said pipe stem such that, when a coupler is attached to the free end of a cradled pipe stem in said staging tray and said stop plate is engaged in a cradle slot and straddling said pipe stem, extension of said piston rods pulls said cradled pipe stem horizontally.

7. A machine for pushing or pulling pipe horizontally through space underground comprising:

(a) a chassis component comprising a frame having a front and back end, said back end including a back plate having an opening for receiving a pipe to be pushed or pulled horizontally through space, and a pair of parallel, horizontally positioned piston cylinders with extendable, hydraulically controlled piston rods, and, coupled to said extendable piston rods, (b) a staging tray comprising an open path cradle dimensioned to receive a standard dimensioned pipe stem, said cradle comprising a plurality of slots for receiving both a positionable ram plate dimensioned to contact a free end of a cradled pipe stem, and a positionable stop plate dimensioned to straddle a said cradled pipe stem but not a coupler attached to a free end of said pipe stem, such that, when said machine front end faces the ground space through which said pipe is to be pushed through horizontally and said ram plate is in a said slot and in contact with a free end of a said cradled pipe, extension of said piston rods pushes said pipe horizontally through said ground space, and when said machine back end faces said ground space, a coupler is attached to a free end of a said cradled pipe stem in said staging tray and said stop plate is in a said slot, straddling said pipe stem, extension of said piston rods pulls said pipe horizontally from said ground space.

8. The machine of claim 7 competent to expand a bore hole through said pulling action.

* * * * *